United States Patent [19]

Tanaka et al.

[11] Patent Number: 4,569,708

[45] Date of Patent: Feb. 11, 1986

[54] METHOD FOR COVERING CABLES WITH SHEATHS FOR CORROSION PROTECTION AND/OR AESTHETICS

[75] Inventors: Yoshito Tanaka, Suita; Toshio Haraguchi, Ibaraki, both of Japan

[73] Assignee: Shinko Kosen Kogyo Kabushiki Kaisha, Amagasaki, Japan

[21] Appl. No.: 631,205

[22] Filed: Jul. 16, 1984

[51] Int. Cl.[4] ..... B32B 31/04; B32B 7/04

[52] U.S. Cl. ..... 156/91; 14/22; 156/294; 156/304.2; 428/36; 428/375

[58] Field of Search ..... 14/22, 74; 156/52, 304.2, 156/91, 294; 428/36, 375

[56] References Cited

U.S. PATENT DOCUMENTS 2,061,350 11/1936 Coupier et al. ..... 156/52 X
3,088,269 5/1963 Shields ..... 14/22
3,105,287 10/1963 Whearley et al. ..... 156/52 X

FOREIGN PATENT DOCUMENTS 56-167010 12/1981 Japan .
57-20443 4/1982 Japan .
57-59355 12/1982 Japan .

*Primary Examiner*—Robert A. Dawson
*Attorney, Agent, or Firm*—Oblon, Fisher, Spivak, McClelland & Maier

[57] ABSTRACT

A method of fitting a generally cylindrical corrosion protective and/or aesthetic sheath on a cable, which method includes the steps of fitting a sheath unit on one end of a cable; shifting the position of the fitted sheath unit toward the other end of the cable; fitting a fresh sheath unit similarly on the cable in continuation from the preceding sheath unit; and repeating the fitting of a fresh sheath unit and the shift of the preceding sheath until the cable is covered with the sheath units substantially over the entire length thereof.

13 Claims, 15 Drawing Figures

METHOD FOR COVERING CABLES WITH SHEATHS FOR CORROSION PROTECTION AND/OR AESTHETICS

BACKGROUND OF THE INVENTION

1. Field of the Invention

This invention relates to improvements in and relating to a method for fitting corrosion protective and/or aesthetic sheaths on tension members of suspension bridges, suspended roofs, cable stayed bridges and the like.

2. Description of the Prior Art

The circumferential surfaces of the tension members of this sort are usually covered with generally cylindrical sheaths for protection against corrosion. However, such corrosion protection sheaths are often found to be inconvenient since it becomes difficult to take up a tension member on a reel for storage or for other purposes once a sheath is fitted on the tension member before use. Therefore, it has been the conventional procedure to thread a tension member through cylindrical sheaths which are provided on scaffolds which are errected at suitable intervals along the tension member to be installed for protection against corrosion, or to fit sheaths on an installed cable by climbing on a scaffold which is provided along the entire length of the cable. Thus, the conventional protection sheaths invariably require a scaffold or scaffolds for fitting them on a cable, and necessitate to the building of scaffolds of a large scale for long cables, resulting in a high construction cost and an unduly long construction period.

SUMMARY OF THE INVENTION

The present invention contemplates solving the above-mentioned problems or difficulties. It is a more specific object of the present invention to provide a method for covering tension members consisting of bundles of steel, wires, strands, wire ropes or high strength bars (hereinafter called "cables") with corrosion protection and/or aesthetic sheaths in a simplified manner, which does not require provision of a scaffold or scaffolds for fitting the corrosion protective sheaths on cables and which can realize significant reductions in cost and time required for the cable installation.

According to one aspect of the invention, there is provided a method for fitting a generally cylindrical corrosion protective and/or aesthetic sheath on a cable, such method comprising fitting a sheath unit on one end of a cable; shifting the position of the fitted sheath unit toward other end of the cable; fitting a fresh sheath unit similarly on the cable in continuation from the preceding sheath unit; and repeating the fitting of a fresh sheath unit and the shifting of the preceding sheath until the cable is covered with the sheath units substantially over the entire length thereof.

In a preferred form of the invention, each corrosion protective and/or aesthetic sheath unit consists of a couple of split segments formed from a synthetic resin such as polyethylene or a metal such as copper, aluminum, stainless steel or the like, and is fitted on a cable such that the split segments are located in staggered positions along the axis of the cable.

The above and other objects, features and advantages of the present invention will become apparent from the following description and appended claims, taken in conjunction with the accompanying drawings which show by way of example some preferred embodiments of the invention.

BRIEF DESCRIPTION OF THE DRAWINGS

In the accompanying drawings:

FIGS. 4, 5(A), 5(B), 6(A), 6(B) and 6(C) are schematic sectional views showing various means for integrally connecting the sheath and cable together;

DETAILED DESCRIPTION OF PREFERRED EMBODIMENTS

Figure 1:
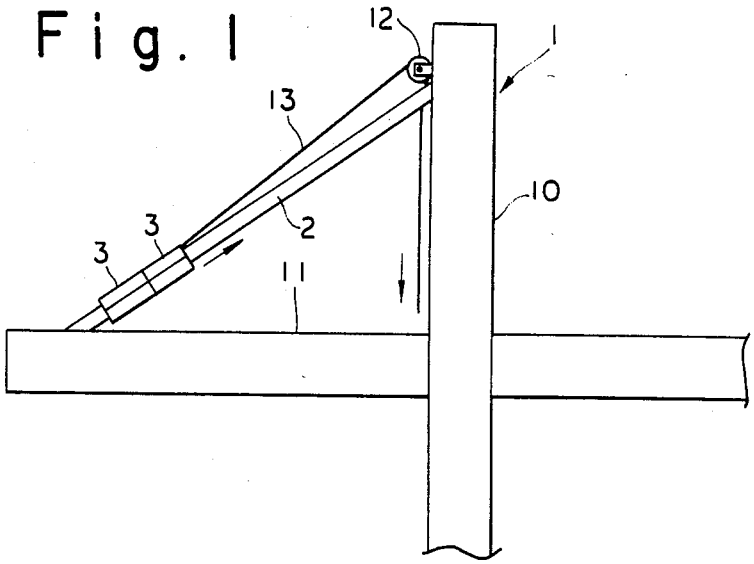
FIG. 1 is a schematic front view of an embodiment of the invention.
Figure 3:
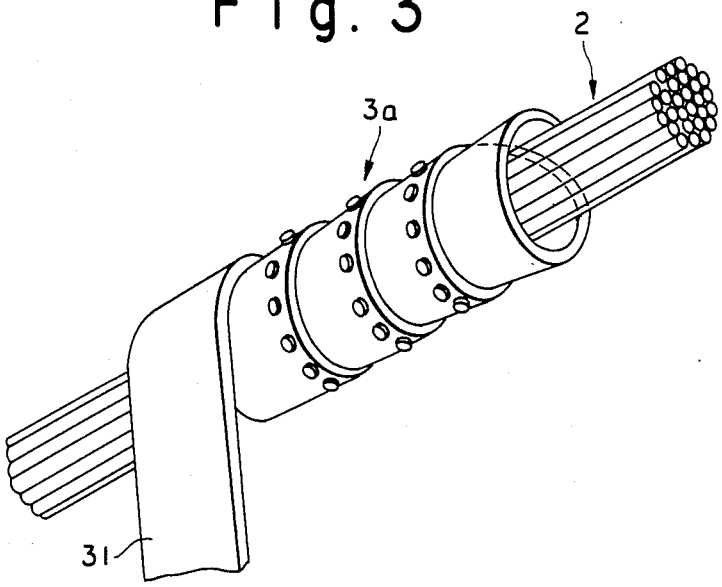
FIG. 3 is a schematic perspective view of a sheath of a different construction.

Referring to the drawings and first to FIG. 1, there is shown part of a cable stayed bridge 1 having a tension member 2, which consists of a bundle of steel wires, strands, wire ropes or high strength bars (hereinafter called "cable") tensioned between an upper end portion of a tower 10 and a beam 11 of the bridge. A cylindrical protective sheath unit 3 of a predetermined length is fitted on the circumference of a lower end portion of the cable 2 immediately above the beam 11. The sheath unit 3 consists of a couple of split segments 30 of a synthetic resin like polyethylene or a metallic material such as copper, aluminum, stainless steel or the like (see FIG. 3). After fitting the split segments 30 on the cable 2, they are secured to each other by bolts, rivets, press-in fit or welding in such a manner as to hold the cable 2 from opposite sides.

The sheath unit 3 thus fitted on the cable 2 is shifted upward along the cable by a distance corresponding to its length by pulling a rope which is passed around a pulley 12 at the upper end of the tower 10, and then a fresh protective sheath unit 3 is fitted on the cable 2 in the same manner. The upper end of the lower or succeeding sheath unit 3 is fitted into the lower end of the preceding sheath unit 3, and the overlapped end portions of the two sheath units 3 are fastened to each other by bolts or other suitable means. If desired, the connecting end portions of the preceding and succeeding sheath units may be secured to each other by butt welding. The two connected sheath units 3 are lifted upward by pulling the rope 13 again, and another fresh protective sheath unit 3 is fitted on the cable 2 and connected to the lower end of the second unit 3. In this manner, fresh protective and/or aesthetic sheath units are connected one after another until the cable 2 is covered with the sheath 3 over the entire length thereof.

In this instance, instead of being lifted by the rope 13, the connected sheath units 3 may be pushed up each time by a distance corresponding to their unit length, or alternatively the first sheath unit 3 may be fitted on the upper end of the cable 2 which is accessible from the top end portion of the tower 10, successively lowering the sheath units 3 along the cable 2 after fitting and connecting fresh sheath units 3 to the upper end of the preceding units 3. Further, it is to be understood that, instead of a pair of split segments 30, each sheath unit may be constituted of three or more segments which can be assembled into a cylindrical shape with a number of pieces in the longitudinal direction, if desired, for fitting the same on the cable 2 by elastic deformation. Furthermore, as shown particularly in FIG. 3, a sheath 3*a* of a desired length can be formed by spirally wrapping a rolled covering strip 31 around the circumference at one end of a cable 2 and fastening the overlapped portions of the covering strips 31 by rivets or other suitable means.

After forming a sheath 3 of a necessary length at one end of the cable 2 in this manner, the sheath unit 3 is shifted toward the other end of the cable 2, and a fresh sheath unit 3 is formed contiguously to the preceding unit 3. Consequently, there is no necessity of providing a scaffold or scaffolds as required by the conventional methods, and it becomes possible to reduce the installation cost as well as markedly reducing the time of construction.

Figure 4:
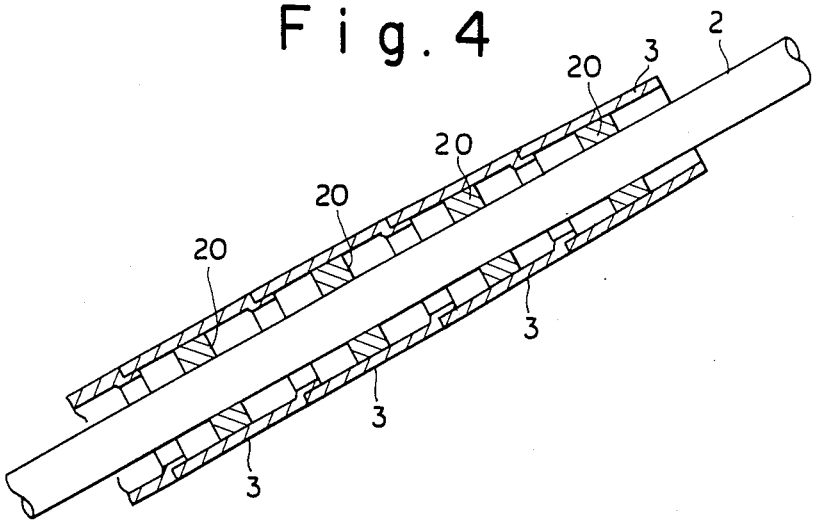
Figure 5A:
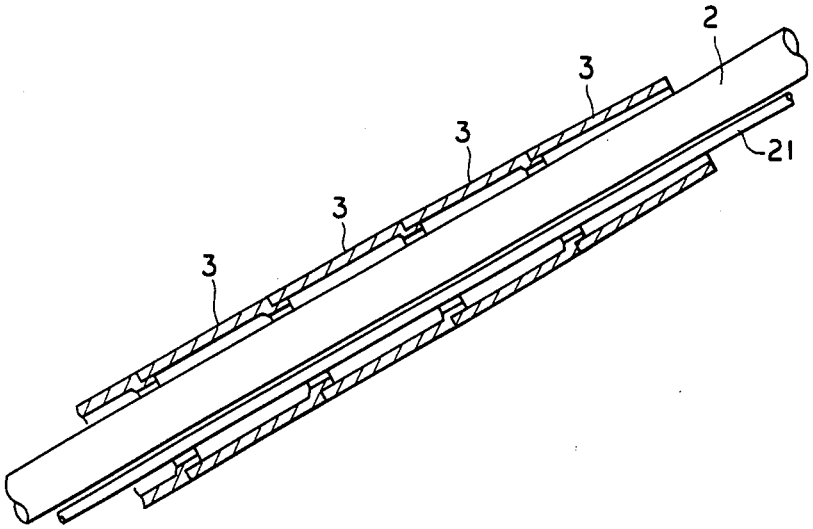
Figure 5B:
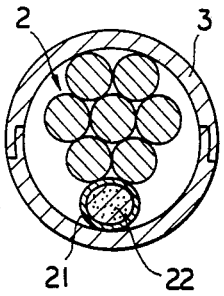
Figure 5C:
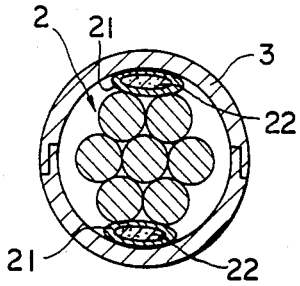
Figure 6A:
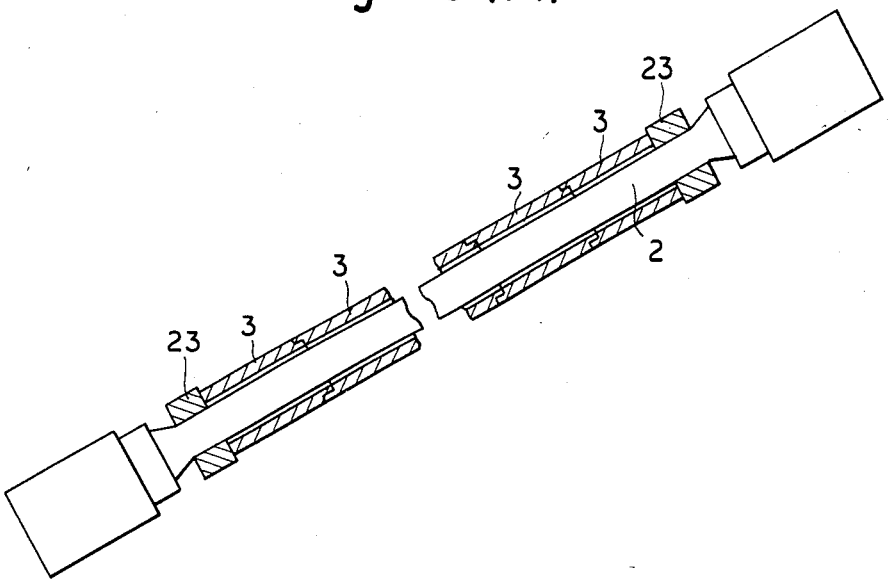
Figure 6B:
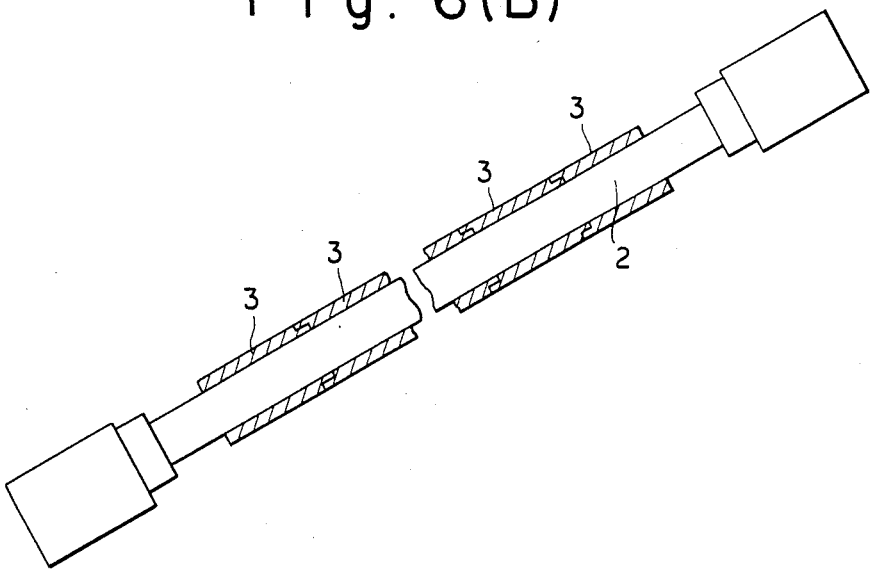

In order to lessen the frictional resistance at the time of moving the joined sheath units toward the other end of the cable 2, it is desired to leave a predetermined clearance (normally about 2–60 mm in gap) between the inner surfaces of each sheath unit 3 and the circumference of the cable 2. However, if such a clearance exists after installation, the sheath 3 may vibrate independent of the cable 2 by winds or by other external disturbances, so that there is a possibility of noise being produced or the sheath being damaged. These problems can be precluded by integrating the sheath 3 and cable 2, for example, by providing cushion material 20 such as sponge, sponge rubber, curled stainless steel wire or a spring on the inner surface of the sheath 3 or on the circumferential surface of the cable 2 as shown in FIG. 4. With this arrangement, the protective and/or aesthetic sheath 3 can be moved with a small frictional resistance due to elastic deformation of the cushion material 20, and, after installation, the sheath 3 and cable 2 are integrally joined to each other by the cushion material 20. Similar effects can be obtained by providing, instead of the cushion material 20, an age-hardening type tacky material such as silicon, foamable urethane or the like. It is also possible to lay one or more inflatable tubes 21 along the the cable 2 as shown in FIG. 5(A), inflating the tubes 21 by introducing a filler 22 thereinto as shown in FIGS. 5(B) 5(C) until the tubes 21 completely support the sheath 3 on cable 2 to connect them integrally to each other. Alternatively, the cable 2 may be temporarily held in a reduced diameter by compressing opposite end portions of the cable 2 with clamps 23 while the sheaths are fitted thereon as shown particularly in FIG. 6(A), removing the clamps 23 afterwards so that the cable 2 may be integrally connected to the sheath 3 by restoration of its normal diameter as shown in FIG. 6(B).

Figure 7:
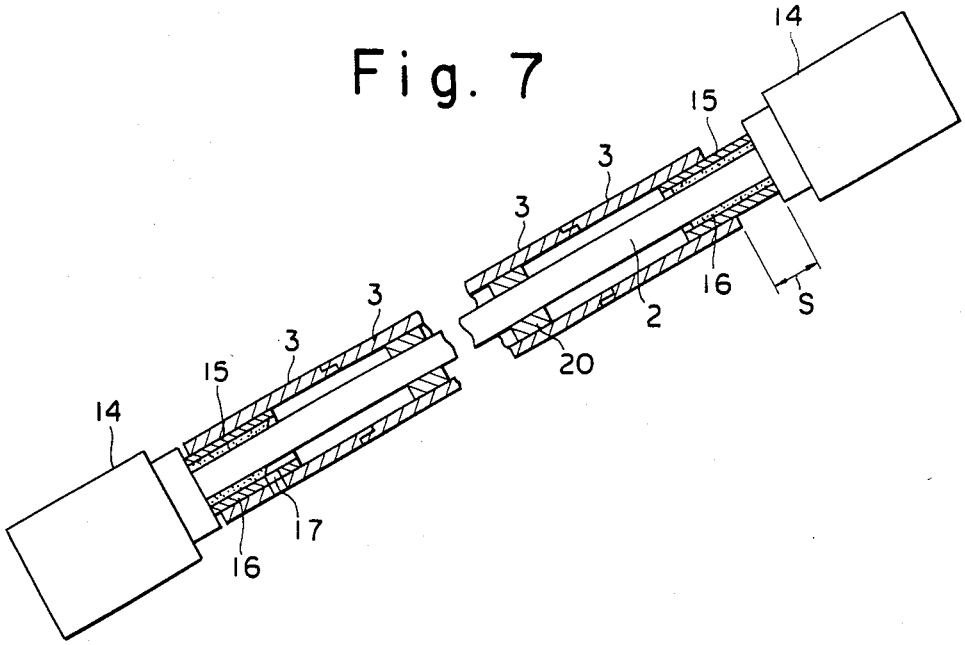
FIGS. 7 and 8 are schematic sectional views showing the construction utilized at the terminal ends of a cable.

As illustrated in FIG. 7, the upper and lower ends of the cable 2 are fixed by sockets 14, and each end portion of the connected sheath unit is fitted on a pipe 15 of polyethylene, steel or the like which is retained in the socket 14, thereby preventing each end portion of the cable 2 from being exposed to the weather and at the same time improving the corrosion resistance of each end portion of the cable 2 and its appearance. In order to further improve the corrosion resistance of each end portion of the cable 2, it is desirable to fill the pipes 15 with a filler material 16 of a synthetic resin, rubber or the like. Furthermore a water drain hole 17 may be provided at the lower end of the sheath 3 at a position opposing a slant surface of the filler material 16 to drain water which might enter the sheath 3 through its riveted joints.

Figure 2:
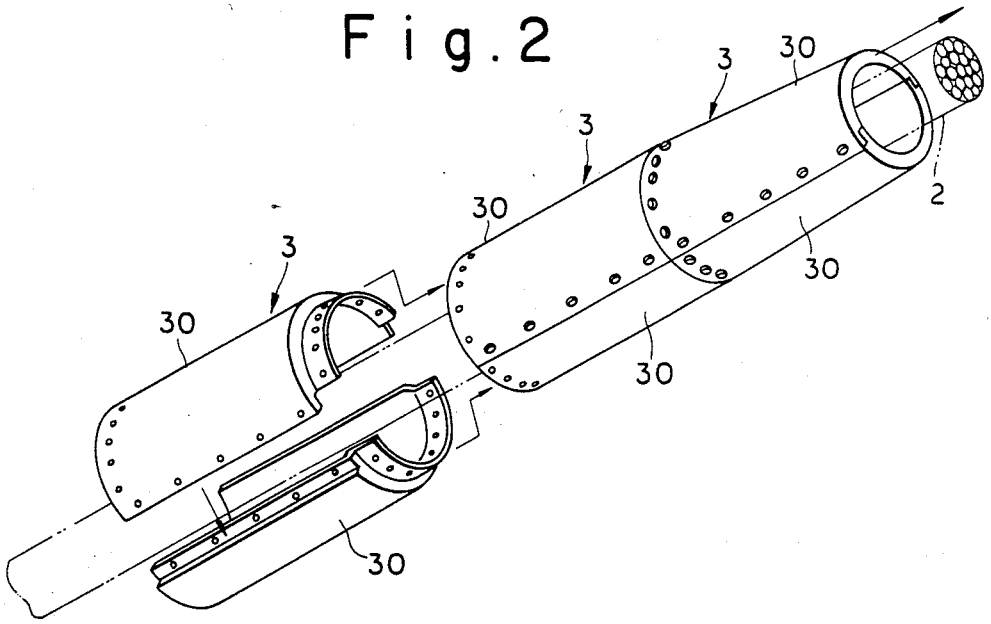
FIG. 2 is a schematic perspective view of split sheath segments constituting a train of sheath units.
Figure 8:
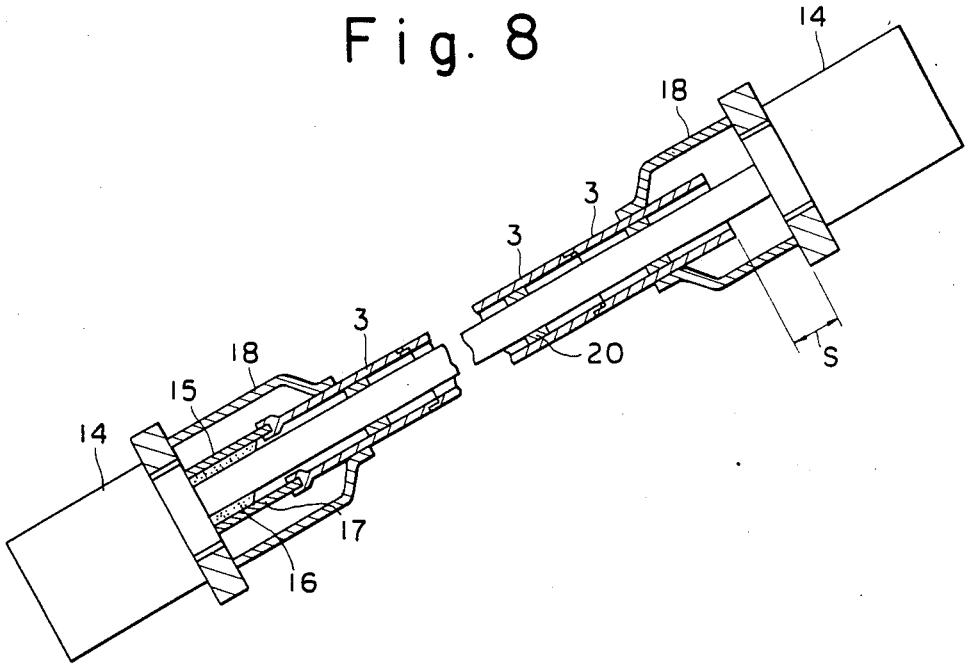

Shown in FIG. 8 is another embodiment in which each end of the sheath 3 is fitted in trumpet sheath 18 which is provided on the anchorage attachment. In a situation where there is a difference in linear thermal expansion coefficient between the cable 2 and sheath 3, it is desirable to provide a space S between the upper end of the sheath 3 and socket 14 to thereby absorb the difference in the thermal expansions and contractions as shown in FIGS. 7 and 8, or to provide an extensible joint in an intermediate portion of the sheath 3. In the case of a very long cable 2, there are possibilities of a corrosion resistant layer of the cable 2 being damaged due to sliding movement of to the cable 2 within the sheath 3 due to thermal expansion or contraction. This can be prevented suitably by the provision of the above-mentioned cushioning material 20. Accordingly, it is preferred to provide the cushion material 20 between the circumferential surface of the cable 2 and the inner surface of the sheath 3 in the embodiments shown in FIGS. 5(A), 5(B) and 5(C) and FIGS. 6(A) and 6(B). Where it is intended to bore apertures or tapped holes in the sheaths 3 and 3*a* of FIGS. 2 and 3 respectively on a construction site for receiving rivets or bolts which fasten the connecting portions of the split sheath segments 30 or of the adjacent sheath units 3, it is desirable to provide projections on the inner surfaces of the sheaths 3 and 3*a* or to maintain a clearance of a predetermined gap between the sheaths 3 and 3*a* and the cable 2 by interposition of a spacer or other suitable means to prevent the cable 2 from being damaged by a drill or other tools.

Figure 9:
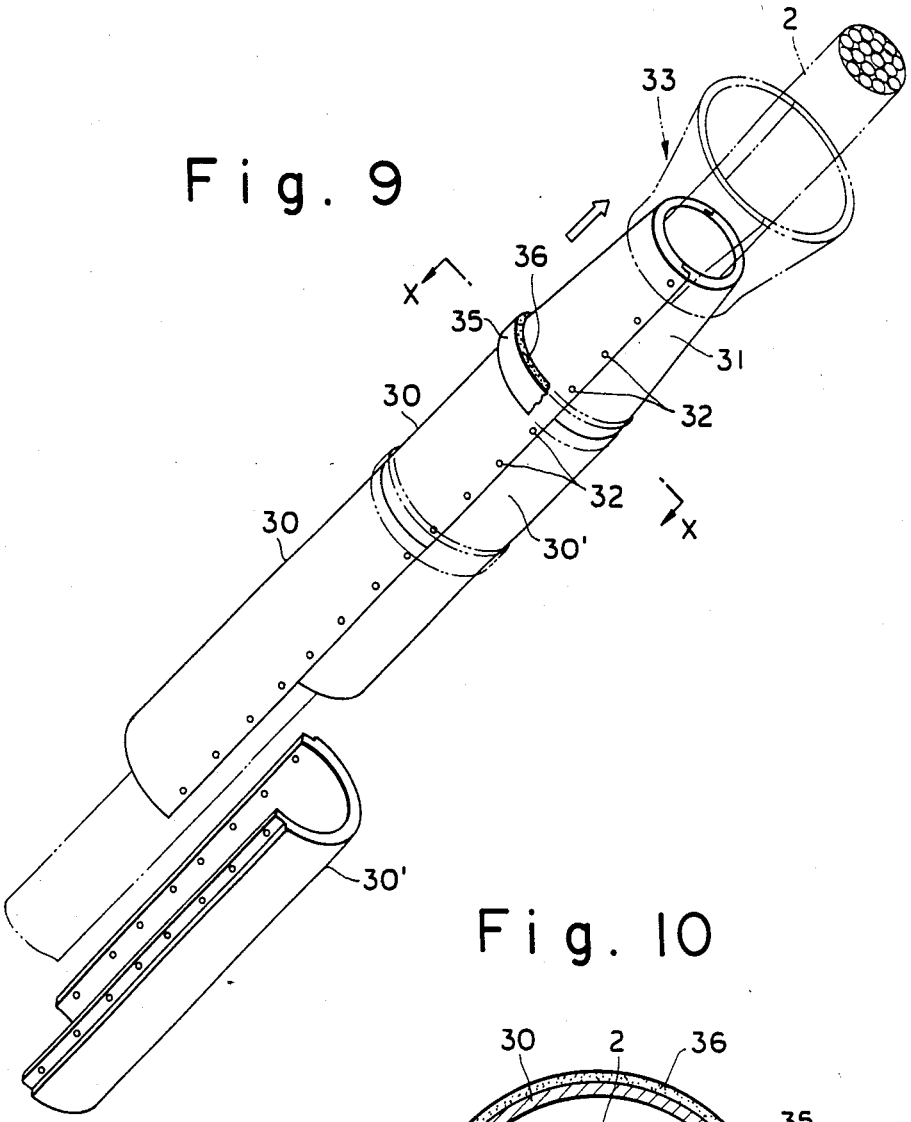
FIG. 9 is a schematic perspective view showing another embodiment of the invention.

Referring to FIG. 9, there is shown a further embodiment of the invention, in which the opposing semi-cylindrical segments of each sheath unit are connected in staggered positions along the length of the cable. More specifically, as illustrated in FIG. 9, a segment 30 of a predetermined length and a segment 31 of a half length are fitted on the lower end of a cable 2 from opposite sides thereof and connected to each other to form an initial end of a sheath. The long and short segments 30 and 31, which are aligned with each other at the upper ends but have their lower ends terminated at staggered positions in the longitudinal direction, have the longitudinal meeting edges fastened to each other by rivets 32 or other suitable fixing means such as bolts, screws, fit joints, slits or welding. In this instance, a bell-shaped split guide tube 33 is fitted on the cable 2 beforehand to connect thereto the aligned upper ends of the segments 30 and 31. In a manner similar to the foregoing embodiments, the connected sheath segments 30 and 31 are lifted upward by pulling a rope 13, and a segment of the next sheath unit is fastened to the longitudinal edges of the lower half of the longer segment 3 contiguously to the lower end of the short segment 31. Namely, the segments 30 and 30′ of each sheth units are connected to each other and to a segment of a preceding or succeeding sheath unit in longitudinally staggered positions by rivets 32 or other fastening means which secure the longitudinal meeting edges of the respective segments.

Figure 10:
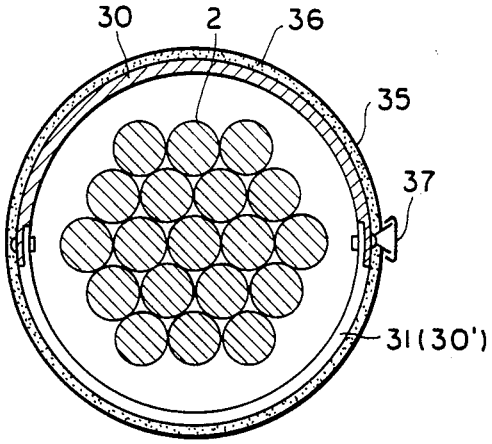
FIG. 10 is a schematic sectional view taken on line X—X of FIG. 9.
Figure 11:
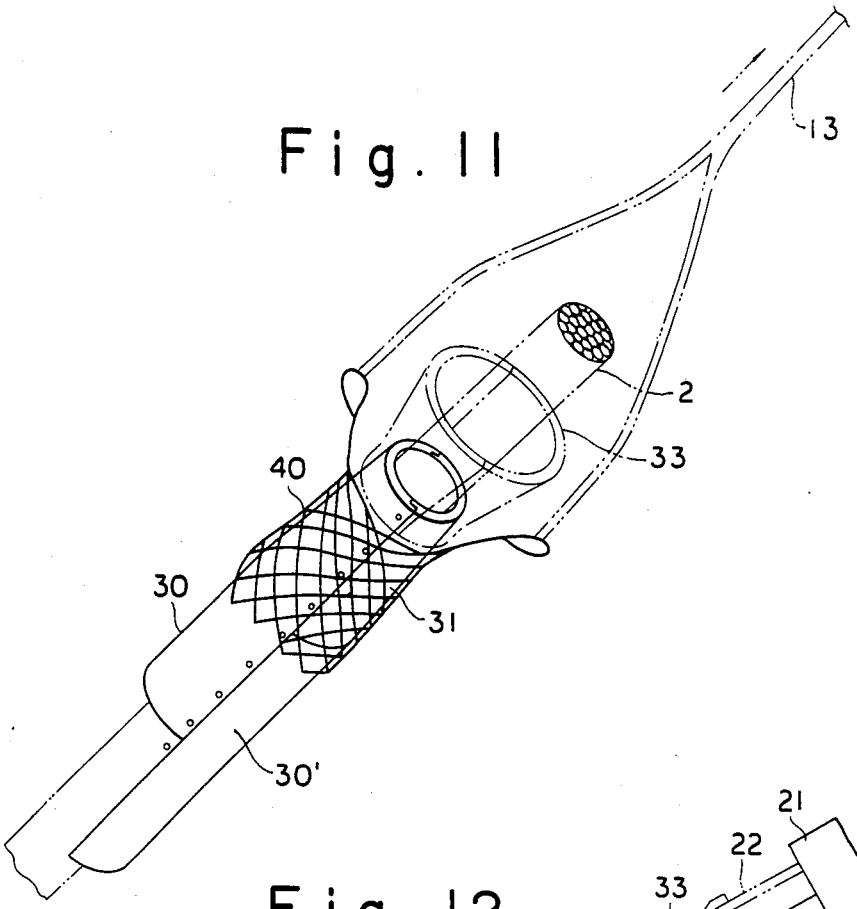
FIG. 11 is a schematic perspective view showing an example of the segment lifting means.

In this manner, the segments 30 and 30' of the succeeding sheath units are connected one after another at the lower end of the cable 2, while upwardly lifting the connected sheath units after connection of a single or a couple of fresh segments by a distance corresponding to an increment in length of the connected sheath train. Since the segments 30 and 30' are connected to each other as well as to a staggered segment 30 and 30' of a longitudinally adjacent sheath unit, there is no necessity of providing fastening means for connecting the butted ends of longitudinally adjacent sheath segments and therefore the connecting work can be simplified to a significant degree. In this case, in order to prevent invasion of water through the abutted ends of the adjacent sheath segments, it is desirable to fit around the butted ends a hoop strap 35 with a back-up material 36 such as silicon rubber, duplex adhesive tape or the like, fixing the hoop strap 35 in position by a caulking strip 37 or the like (FIGS. 9 and 10). The hoop strap 35 can be omitted in case the opposing end portions of the adjacent sheath segments are so shaped as to be connected with each other by fitting engagement.

For lifting up the connected segments by the rope 13, there may be employed a cable grip 40 of a net-sock which is fitted around the segments 30 and 31 of the leading sheath unit, and has loops at its fore end connected to the rope 13 so that the grip 40 is tightened to lift the sheath segments 30 and 31 as the rope 13 is wound up by a winch 14.

Figure 12:
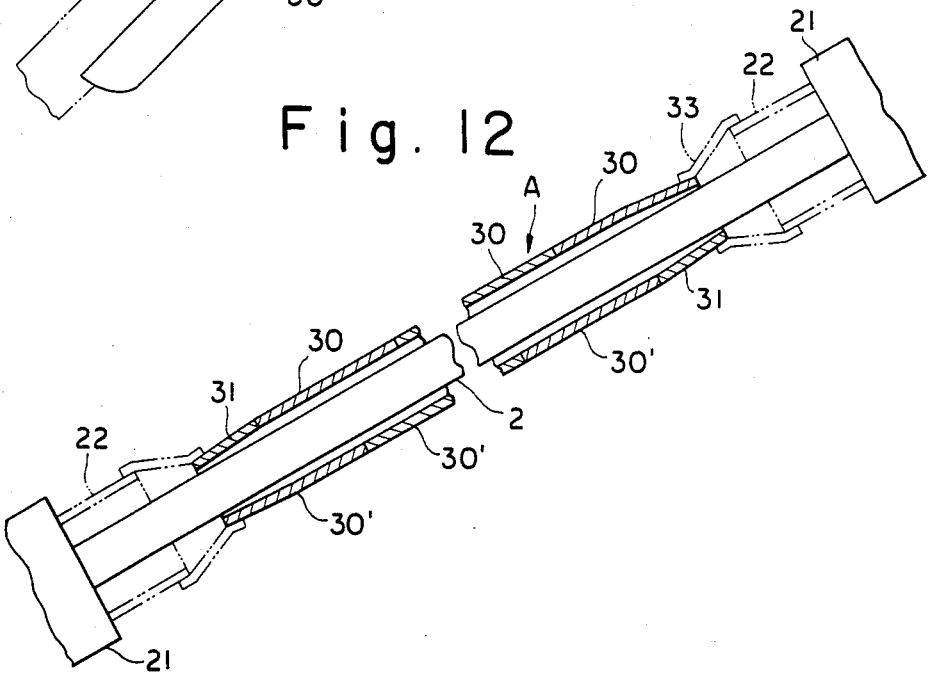
FIG. 12 is a schematic sectional view a completely sheathed cable.

In this manner, the connection of fresh sheath segments and the upward lifting of the connected sheath segments are repeated alternately until the segments 30 and 31 at the leading end reaches the upper end of the cable 2, forming a continuous cylindrical sheath A over the entire length of the cable 2 as shown particularly in FIG. 12. The lower ends of the opposing sheath segments at the terminal end of the sheath A are compensated with each other by the use of a short segment 31 in the same manner as at the leading end of the sheath A, and the opposite ends of the sheath A are connected respectively to connecting pipes 22 on sockets 21 through the trumpet sheath 33.

Although the method of the invention has been described specifically by way of preferred embodiments, it is to be understood that various modifications and alterations can be made thereto without departing from the technical scope as encompassed by the following claims.

What is claimed is:

1. A method for fitting a generally cylindrical corrosion protective and/or aesthetic sheath on a cable, which comprises:

fitting a first sheath unit on one end of said cable;

shifting the position of said first sheath unit toward the other end of the cable;

fitting a second sheath unit similarly on said cable serially with said first sheath unit; and repeating fitting of additional sheath units and shifting of position of said additional sheath units so as to cover said cable with said sheath units substantially over the entire length thereof; and providing a clearance of a predetermined gap, normally in the range of 2–60 mm between an inner surface portion of each sheath unit and a circumferential surface portion of said cable for reducing frictional resistance upon shifting said sheath unit along said cable.

2. A method as set forth in claim 1, wherein said cable further comprises a plurality of steel wires, strands, wire ropes or high strength bar and said sheath unit includes a pair of semi-cylindrical split segments formed of a synthetic resin material including polyethylene or a metallic material including copper, aluminum and stainless steel.

3. A method as set forth in claim 2, which further comprises integrally connecting said sheath unit to the circumference of said cable by a cushion material provided on the inner surface of said sheath unit or on the circumferential surface of said cable.

4. A method as set forth in claim 2, which further comprises integrally connecting said sheath unit to the circumference of said cable by an age-hardening type tacky material applied on the inner surface of said sheath unit or on the circumferential surface of said cable.

5. A method as set forth in claim 2, which further comprises embedding at least one inflating tube between said sheath units and cable, and introducing a filler material into said inflating tube after fitting said sheath units on said cable, thereby expanding said tube to support said sheath units on said cable for connecting the same integrally with each other.

6. A method for fitting a generally cylindrical corrosion protective and/or aesthetic sheath on a cable, which comprises:

fitting a first sheath unit on one end of said cable;

shifting the position of said first sheath unit toward the other end of the cable;

fitting a second sheath unit similarly on said cable serially with said first sheath unit; and repeating fitting of additional sheath units and shifting of position of said additional sheath units so as to cover said cable with said sheath units substantially over the entire length thereof;

forming each of said sheath units from a plurality of split segments; and fitting said split segments of each sheath unit on said cable from opposite sides thereof in staggered positions in a longitudinal direction of said cable and fastening longitudinal meeting edges of said split segments to each other and to a segment of a preceding or succeeding sheath unit to form on said cable a cylindrical sheath comprising a series of longitudinally connected sheath units having opposite ends of the respective split segments abutted against split segments of an adjacent sheath unit in staggered positions.

7. A method as set forth in claim 6, which further comprises fitting a hoop strap on and around the abutted ends of said split segments of adjacent sheath units and fixed in position by a caulking strip, said hoop strap being held in tight contact with the circumferential surfaces of said split segments through a back-up material applied on the inner surface of said hoop strap.

8. A method as set forth in claim 7, wherein said back-up material further comprises silicon rubber.

9. A method as set forth in claim 7, wherein said back-up material further comprises a duplex adhesive tape.

10. A method as set forth in claim 7, which further comprises connecting said abutted ends of split segments of adjacent sheath units by fitting engagement with each other.

11. A method as set forth in claim 1, which further comprises successively pulling said sheath units fitted on said cable upward by a rope connected to an initial end of said sheath.

12. A method as set forth in claim 1, which further comprises successively pushing said sheath units fitted on said cable up each time by a predetermined distance along said cable.

13. A method as set forth in claim 1, which further comprises fitting said sheath units one after another on an upper end portion of said cable and successively moving said sheath units toward the lower end of said cable.

* * * * *